US006338641B2

(12) United States Patent
Nicholls

(10) Patent No.: US 6,338,641 B2
(45) Date of Patent: Jan. 15, 2002

(54) ELECTRICAL CONNECTOR

(75) Inventor: Bryce Lindsay Nicholls, New South Wales (AU)

(73) Assignee: Krone GmbH (DE)

( * ) Notice: Subject to any disclaimer, the term of this patent is extended or adjusted under 35 U.S.C. 154(b) by 0 days.

(21) Appl. No.: 09/847,738

(22) Filed: May 2, 2001

Related U.S. Application Data

(62) Division of application No. 09/360,239, filed on Jul. 23, 1999.

(30) Foreign Application Priority Data

Jul. 24, 1998 (AU) ..... PP 4849/98

(51) Int. Cl.[7] ..... H01R 4/24
(52) U.S. Cl. ..... 439/402
(58) Field of Search ..... 439/404, 395, 439/397, 676, 883, 884, 885, 402, 400

(56) References Cited

U.S. PATENT DOCUMENTS 5,060,372 A * 10/1991 Capp et al. ..... 439/885
6,086,405 A * 7/2000 Liebich ..... 439/397
6,264,511 B1 * 7/2001 Bu ..... 439/885
6,280,230 B1 * 8/2001 Takase et al. ..... 439/395
6,190,531 B1 * 9/2001 Onizuka et al. ..... 439/397

* cited by examiner

*Primary Examiner*—Brian Sircus
*Assistant Examiner*—Phuong Dinh
(74) *Attorney, Agent, or Firm*—McGlew and Tuttle, P.C.

(57) ABSTRACT

Electrical connector having an insulative body (12) with contact elements (32). The contact elements (32) have at one end thereof spring contact portions (40) arranged within a socket (44). The other ends of the contact elements (32) have pairs of insulation displacement contact parts (28). The pairs of contact parts (28) enable two wires to be connected to each contact element (32). The contact elements (32) are formed from blanks (**56*a*, 56*b*) stamped from a strip as a lead frame 54. Contact portions (38), on which each pair of contact parts (28) are formed, are formed in rows at each edge of the lead frame strip, with the spring contact portions (40**) extending inwardly from the strip edges at 45° to the strip edges.

4 Claims, 4 Drawing Sheets

FIG 1
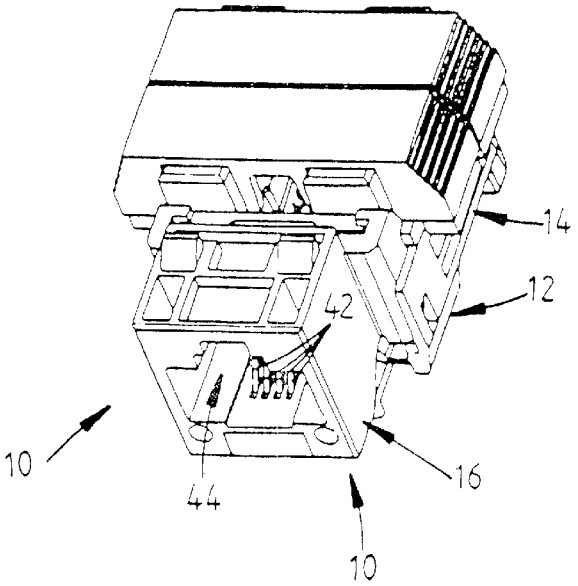
FIG 2
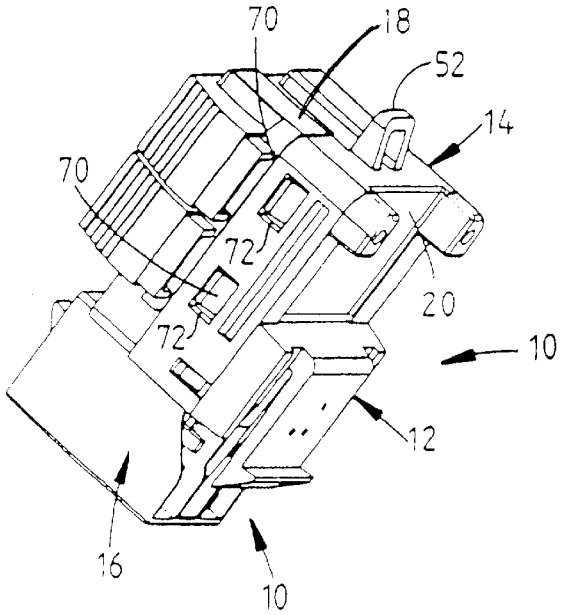
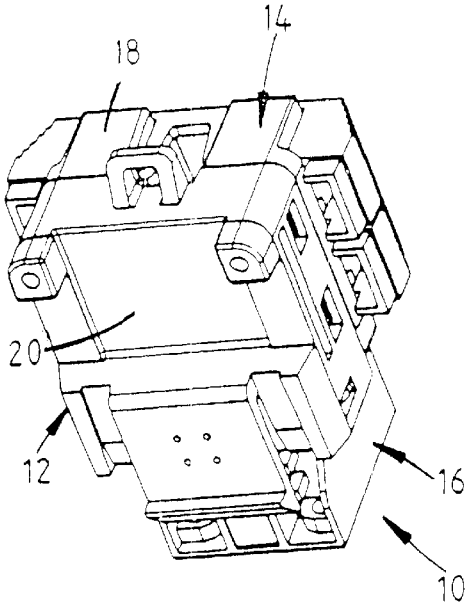
FIG 3
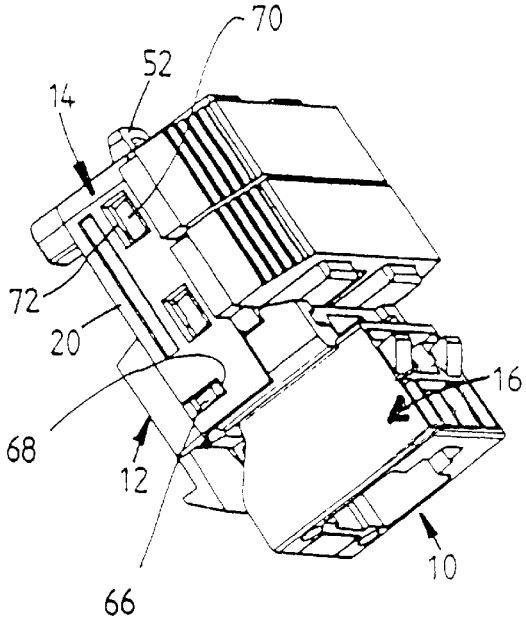
FIG 4

ELECTRICAL CONNECTOR

This is a Divisional of application Ser. No. 09/360,239 filed Jul. 23, 1999, and the entire disclosure of this prior application is considered to be part of the disclosure of the accompanying application and is hereby incorporated by reference therein.

FIELD OF THE INVENTION

This invention relates to an electrical connector. The invention also relates to a lead frame for forming an electrical connector element, and a method of forming blanks for forming electrical contact elements.

BACKGROUND OF THE INVENTION

U.S. Pat. No. 5,186,647, for example, discloses an electrical connector having: electrical contact parts to which electrical connections to conductive wires are in use made; and a socket for receiving a mating plug such that elongate electrical contact portions of the connector electrically connect to connection parts of the plug; the elongate electrical contact portions being formed on respective separate electrical contact elements of the connector, which contact elements each have formed thereon such contact parts; the elongate contact portions being arranged, over substantial parts of the lengths thereof, in generally parallel disposition substantially in a common plane, and the contact parts extending substantially normally away from said plane, at one side of the plane, to free ends of the contact parts arranged in rows extending generally parallel to the direction of extent of the elongate contact portions.

With prior connectors of this kind, each contact part is provided on a separate contact element and multiple connections to the contact elements via these may not be easily affected.

SUMMARY AND OBJECTS OF THE INVENTION

In one aspect, it is an object of the invention to provide an electrical connector which facilitates the making of plural connections to the connector elements. In this aspect, the invention provides that the first and second contact parts of each contact element are generally planar and disposed in angular disposition with respect to each other.

Preferably, the contact parts are bifurcated whereby the contact parts define respective insulation displacement connector parts.

Preferably, the first and second contact parts of each contact element are arranged in a V-shaped configuration, viewed in the direction of extent of these away from the plane. This permits an efficient manner of forming the contact elements. The electrical connector may, in that regard, have four contact elements with the first and second contact parts of two of these disposed in a first row and the first and second contact parts of the other two contact elements disposed in a second row, these rows being substantially parallel to the directions of extent of the elongate contact portions.

In another aspect, the invention provides a lead frame in the form of a strip defining substantially stamped out but interconnected contact blanks for forming respective electrical connector elements. In this aspect, a lead frame as last described is provided with:

first and second lengthwise extending rows of the contact blanks having side by side adjacent first portions, positioned at respective first and second edge portions of the strip adjacent respective first and second lengthwise edges of the strip;

the first portions each defining respective first and second bifurcated contact parts which are spaced apart in the lengthwise direction of the strip;

the first and second contact parts of each said first portion joining at a base part of the respective first portion;

the base parts of the first portions being joined to elongate portions of the respective contact blanks; and the elongate portions of the contact blanks extending away from the respective first portions transversely of the strip at an angle to the edges of the strip, and such that the elongate portions of the contact blanks having the first portions thereof at one said side edge portion are parallel to and interposed between the elongate portions of the contact blanks having the first portions thereof at the other said side edge portion.

The invention also provides a method of forming blanks for forming respective electrical contact elements, from a strip, the method including:

forming side by side adjacent first portions of the blanks, positioned at respective first and second edge portions of the strip adjacent respective first and second lengthwise edges of the strip, the first portions each defining respective first and second bifurcated contact parts which are spaced apart in the lengthwise direction of the strip, the first and second contact parts of each first portion joining at a base part of the respective first portion;

forming elongate portions of the respective contact blanks, which are joined to the base parts of the first portions;

the elongate portions of the contact blanks extending away from the respective first portions transversely of the strip at an angle to the edges of the strip, and such that the elongate portions of the contact blanks having the first portions thereof at one side edge portion are parallel to and interposed between the elongate portions of the contact blanks having the first portions thereof at the other side edge portion.

The invention further provides an electrical connector having contact elements formed from the lead frame of the invention or by the method last described.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a right front top perspective view of an electrical connector constructed in accordance with the invention, having removable covers affixed thereto;

FIG. 2 is a right rear bottom perspective view of an electrical connector constructed in accordance with the invention, having removable covers affixed thereto;

FIG. 3 is a left rear bottom perspective view of an electrical connector constructed in accordance with the invention, having removable covers affixed thereto;

FIG. 4 is a left front top perspective view of an electrical connector constructed in accordance with the invention, having removable covers affixed thereto;

DESCRIPTION OF THE PREFERRED EMBODIMENT

Figure 5:
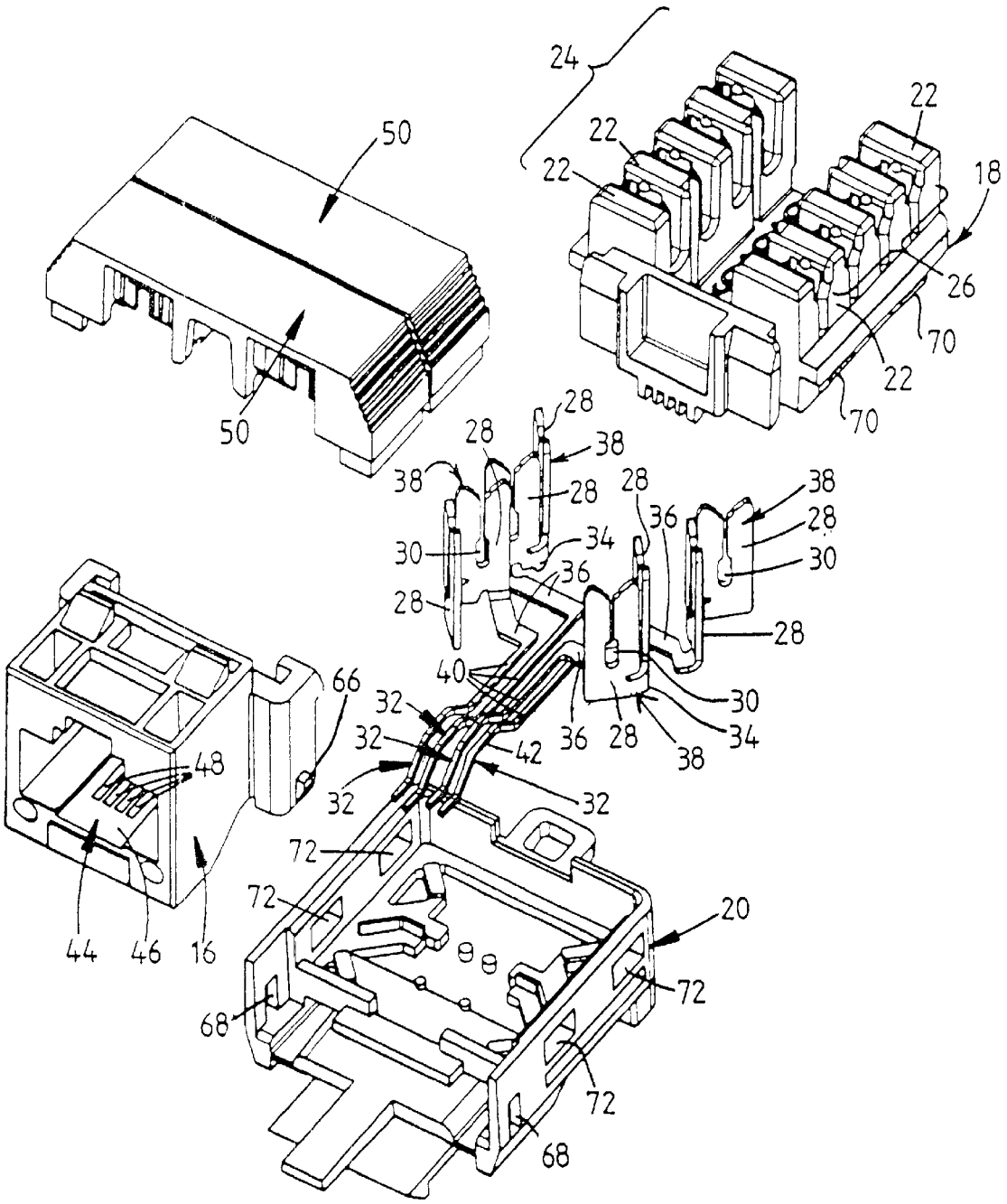
FIG. 5 is an exploded perspective view of the connector of FIG. 1.
Figure 6:
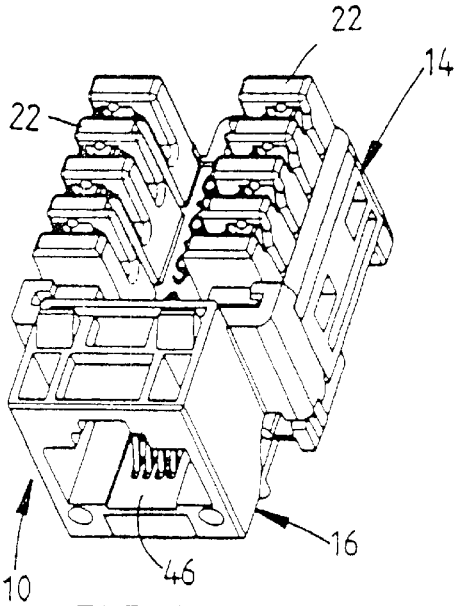
FIG. 6 is a right front top perspective view of an electrical connector of FIG. 1 with the covers removed.
Figure 7:
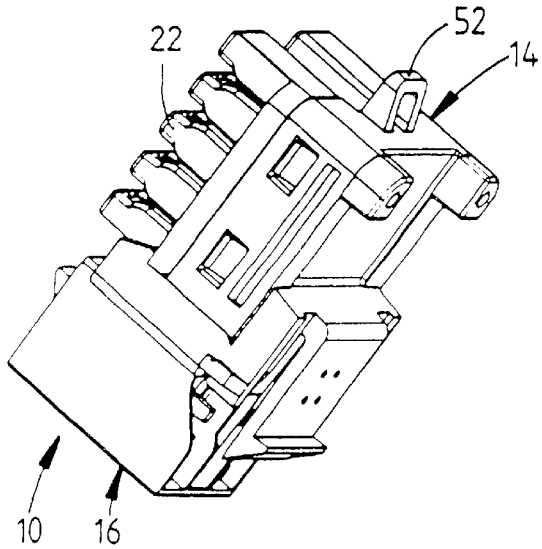
FIG. 7 is a is a right rear bottom perspective view of an electrical connector of FIG. 1 with the covers removed.
Figure 8:
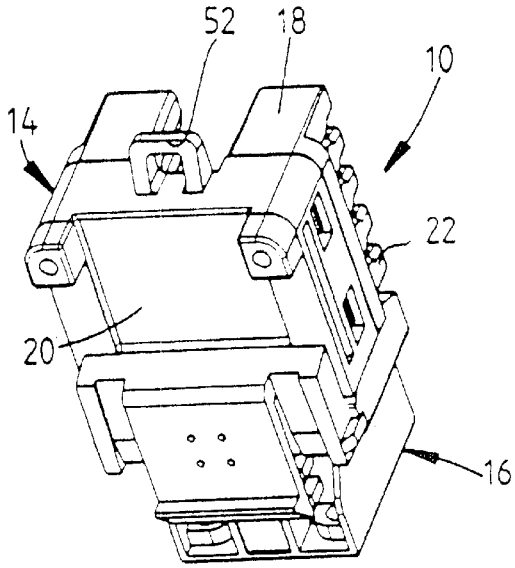
FIG. 8 is a left rear bottom perspective view of an electrical connector of FIG. 1 with the covers removed.
Figure 9:
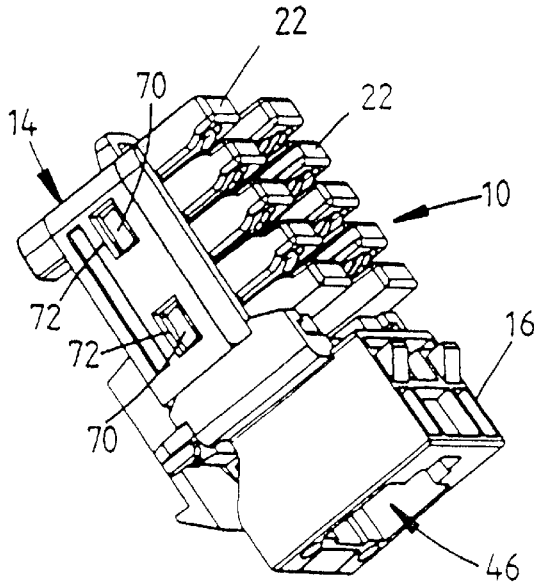
FIG. 9 is a left front top perspective view of an electrical connector of FIG. 1 with the covers removed.

Referring to the drawings in particular, the electrical connector 10 shown in FIGS. 1 to 9 has an insulative connector body 12 with a first body portion 14 and a second body portion 16. Body portion 14 is formed from upper and lower parts, 18 and 20. The upper part 18 has upstanding posts 22 arranged in two rows 24, 26 (FIG. 5) and between which posts in each row are arranged bifurcated contact parts 28 which form insulation displacement connectors for making electrical connections to electrical conductors of insulated wires. Thus, the contact parts 28 have slots 30, and connections to the wires are made by positioning end portions of the insulated wires into troughs between adjacent ones of the posts 22, such that the wire end portions extend transversely to the directions of extent of the rows 24, 26 of posts, and then pressing the wires downwardly so that these enter the slots 30. During this downward pressing, the portions of the contact parts 28 defining the edges of the slots 30 pierce the wire insulation and resiliently engage the inner conductors.

The body portion 16 is removably mountable to the body portion 14 by snap-fit fasteners having parts 66, 68 integrally formed on each of these. The parts 18, 20 of the body portion 14 likewise snap-fit together by means of interengaging snap-fit parts 70, 72, 15 particularly so as to define an internal cavity in which are received four electrical contact elements 32.

Contact parts 28 are formed in pairs, there being two of these defined by each of contact element 32. Particularly, as shown in FIG. 5, the contact parts 28 of each such pair 20 are formed on a single contact portion 38 of the respective contact element 32. Each such portion 38 includes, in addition to the two parts 28, a lower part 34 which interconnects those two contact parts 28.

The portions 38 of each contact element 32 are connected, via intermediate portions 36 thereof, to side-by-side and generally parallel elongate portions 40 of the contact elements.

Substantial parts of the elongate portions 40 extend generally in a common plane, that plane also containing the intermediate portions 36. Elongate portions 40 however have upwardly arched contact parts 42 disposed towards free ends thereof.

The body portion 16 has a socket 44 which is outwardly open and which is capable of receiving an electrical plug, particularly of the kind known as type RJ45. Plugs of this kind have, usually, eight electrical contacts on a face which, when the plug is assembled into the socket 44, is adjacent a wall surface portion 46 of the socket 44. The wall surface portion 46 has slots 48 and the upwardly arched contact parts 42 of the contact elements 32 extend within these in a fashion enabling them to electrically connect to four of the contacts of an RJ45 plug when inserted in the socket 44.

Except for free end portions of the contact elements 32, including the parts 42 thereof, and exposed parts of the contact elements positioned between posts 22, the remainders of these elements are accommodated within the internal cavity defined by the body portion 14. Thus, as viewed in FIG. 5, the contact portions 38 extend downwardly from the upper part 18 of the body portion 14, within the troughs between the posts 22, and into the cavity defined within the body portion 14. Thence, the intermediate portions 36 extend from the contact portions 38 transversely of the connector body (i.e. transversely of rows 24, 26) inwardly to join with respective ones of the elongate portions 40 of the contact elements 32. The elongate portions 40 thence extend forwardly in generally parallel disposition to project through a forward wall of the body portion 14 and thence into the body portion 16, so that parts 42 of the contact elements are accommodated within the slots 48 as mentioned earlier.

The contact parts 28 extend generally normally to the plane containing the major parts of the elongate portions 40 of contact elements 32, and are generally planar. The contact parts 28 of each contact element 32 are however arranged in the V-shaped configuration illustrated, such that the planes of these are arranged at an angle of approximately 90° to each other, and also at approximately 45° to the lengthwise direction of the extent of the rows 24, 26. That is to say, within the troughs between the posts 22, the median planes of the contact parts 28 are is inclined at 45° with respect to the lengthwise directions of the extent of the rows 24, 26, when the contact parts 28 are viewed from above in the view shown in FIG. 5. Further, apices of the V-shaped configurations of the contact parts 28 of the two contact portions 38 closest to body portion 16 face outwardly whereas the apices of the V-shaped configurations of the contact parts 28 of the two contact portions 38 which are furthest from body portion 16 face inwards. By this, in each adjacent row 24, 26, ones of the contact parts 28 on the two contact portions 38 in the row are parallel and the contact parts 28 at the opposite ends of the row are also parallel, but disposed at 90° to the other contact parts of that row.

Two cover members 50 are provided which snap-fit, by means of interengaging snap-fit components (not shown), onto the upper part 18 of body portion 14, so as in use to cover the upper ends of the posts 22 and the upper part 18 of the connector body portion 14. These cover members are fitted to the connector 10 by downward pressing as viewed in FIG. 5 and are provided with internal pressing portions (not shown). Under the action of so connecting the cover members 50 to the body portion 14, these pressing portions are each capable of engaging wires positioned at the upper ends of two of the contact parts 28 in each row 24, 26, so as to press these wires downwardly into the slots 30 of the contact parts 28, during the action of affixing the cover members 50 to the connector 10. By this means, no separate tool is needed to facilitate entry of the wires into the contact parts 28.

By the above arrangement each contact element can be connected to two wires by engaging those wires with the respective contact parts 28 of the contact element. The V-shaped configuration of the contact portions 38 enables a simple and compact arrangement for the connector 10.

The body portion 16 is arranged at one end of the body portion 14. The other end of the body portion 14 is provided with a loop-like retaining element 52 which is capable of accommodating wires to be connected, or already connected, to the connector 10, to retain these on the connector 10, or which may alternatively tie used as a means for tying wires to the body.

Figure 10:
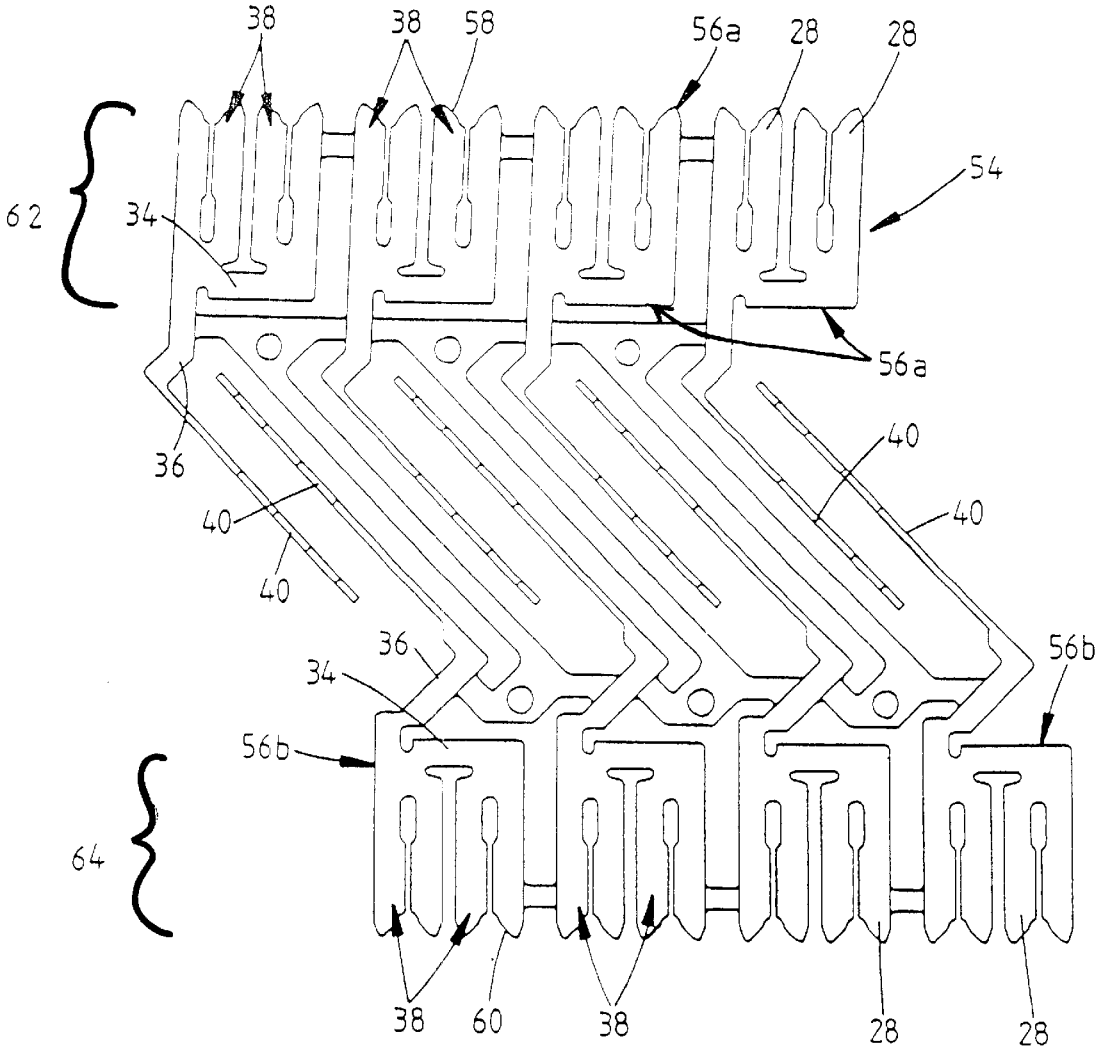
FIG. 10 is a diagram of a lead frame for forming contact blanks used in forming contact elements of the electrical connector of FIGS. 1 to 4 and FIGS. 6 to 9.

The particular form of the contact elements as described lends itself to formation of these by forming the lead frame 54 as shown in FIG. 10. This lead frame 54 is in the form of a strip of electrically conductive material from which contact blanks 56*a*, 56*b* are stamped. These blanks are subsequently deformed, by bending, to form the contact elements 32.

Lead frame 54 has two lengthwise extending side edges 58, 60 and the stamping of the blanks 56*a*, 56*b* is effected in the following way:

a) the portions 38 of the blanks 56*a*, 56*b* are arranged in lengthwise extending rows, those of blanks 56*a* being at side edge 58 and those of blanks 56*b* being at side edge 60, such that portions 38 of blanks 56*a* occupy an edge portion 62 of the lead frame, adjacent side edge 38, and portions 38 of blanks 56*b* occupy an edge portion 64 of the lead frame, adjacent side to edge 60;

b) the parts 34 of the portions 38 connect to intermediate parts 36 of the blanks and thence to the elongate portions 40;

c) the elongate portions 40 of contact blanks 56*a*, (those having portions 38 thereof at edge 58) extend towards edge 60 at an angle of 45°. Likewise, the elongate portions 40 of the contact blanks 56*b* (those disposed with portions 38 adjacent edge 60), extend towards edge 58 at 45° and parallel to the elongate portions 40 of the blanks 56*a;* d) the elongate portions 40 of the contact blanks 56*a* are interleaved with the 15 elongate portions 40 of the contact blanks 56*b*, and spaced from those.

It will be observed that the blanks 56*a* adjacent the edge 58 differ slightly from those adjacent the edge 60 in that the elongate portions 40 of the blanks 56*a* are somewhat longer. When blanks 56*b* are bent to form contact elements 32, they form the two contact elements 32 which are at the end of body portion 14 remote from body portion 16, whereas the contact elements 32 formed from blanks 56*a* form the remaining two contact elements 32.

The described arrangement is particularly convenient in that the contact elements 32 are formed in a way which limits wastage in the strip material from which the contacts are formed.

While a specific embodiment of the invention has been shown and described in detail to illustrate the application of the principles of the invention, it will be understood that the invention may be embodied otherwise without departing from such principles.

What is claimed is:

1. A lead frame in the form of a strip defining substantially stamped out but interconnected contact blanks for forming respective electrical connector elements, the lead frame comprising:

first and second lengthwise extending rows of the contact blanks having side by side adjacent first portions, positioned at respective first and second edge portions of the strip adjacent respective first and second lengthwise edges of the strip, the first portions each defining respective first and second bifurcated contact parts which are spaced apart in the lengthwise direction of the strip, the first and second contact parts of each first portion joining at a base part of the respective first portion, the base parts of the first portions being joined to elongate portions of the respective contact blanks, and the elongate portions of the contact blanks extending away from the respective first portions transversely of the strip at an angle to the edges of the strip, and such that the elongate portions of the contact blanks having the first portions thereof at one said side edge portion are parallel to and interposed between the elongate portions of the contact blanks having the first portions thereof at the other said side edge portion.

2. The lead frame as claimed in claim 1, wherein the elongate portions are joined to the first portions by intermediate portions of the respective blanks.

3. The lead frame as claimed in claim 2, wherein the intermediate portions extend transversely of the directions of extent of the respective elongate portions.

4. The lead frame as claimed in claim 1, wherein said angle is substantially 45°.

* * * * *